US010627132B2

(12) United States Patent
Liang et al.

(10) Patent No.: US 10,627,132 B2
(45) Date of Patent: Apr. 21, 2020

(54) AIR CONDITIONER

(71) Applicant: Gree Electric Appliances, Inc. of Zhuhai, Qianshan Zhuhai, Guangdong (CN)

(72) Inventors: Zhihui Liang, Qianshan Zhuhai (CN); Xianlin Wang, Qianshan Zhuhai (CN); Zhi Meng, Qianshan Zhuhai (CN); Jiebin Yu, Qianshan Zhuhai (CN); Shuangjin Li, Qianshan Zhuhai (CN); Qilong Wang, Qianshan Zhuhai (CN); Zhilin Wang, Qianshan Zhuhai (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 36 days.

(21) Appl. No.: 15/999,306

(22) PCT Filed: Jan. 22, 2017

(86) PCT No.: PCT/CN2017/072062
§ 371 (c)(1),
(2) Date: Sep. 17, 2018

(87) PCT Pub. No.: WO2017/140203
PCT Pub. Date: Aug. 24, 2017

(65) Prior Publication Data

US 2019/0041089 A1 Feb. 7, 2019

(30) Foreign Application Priority Data

Feb. 19, 2016 (CN) ..... 2016 1 0094899

(51) Int. Cl.
*F24F 13/30* (2006.01)
*F04D 29/42* (2006.01)
(Continued)

(52) U.S. Cl.
CPC ..... *F24F 13/30* (2013.01); *F04D 29/00* (2013.01); *F04D 29/4226* (2013.01);
(Continued)

(58) Field of Classification Search
CPC ..... F24F 13/30; F24F 1/0063; F24F 13/20; F24F 1/0022; F24F 1/0011; F24F 1/0047; F24F 1/0067
See application file for complete search history.

(56) References Cited

U.S. PATENT DOCUMENTS 4,553,404 A * 11/1985 Malchow ..... F24F 1/027 415/148
5,709,601 A * 1/1998 Heck ..... B60H 1/00028 454/121
(Continued)

FOREIGN PATENT DOCUMENTS

CN 1229464 A 9/1999
CN 105546661 A 5/2006
(Continued)

OTHER PUBLICATIONS

International Search Report for PCT Patent Application No. PCT/CN2017/072062 dated May 2, 2017. (3 pages).
(Continued)

*Primary Examiner* — Kun Kai Ma
(74) *Attorney, Agent, or Firm* — McAndrews, Held & Malloy, Ltd.

(57) ABSTRACT

An air conditioner, including: a housing (10) having an air inlet (11) and an air outlet (12); a centrifugal fan (20) rotatably disposed in the housing (10), the centrifugal fan (20) including a plate portion (21) and blades (22) disposed on the plate portion (21); a heat exchanger (30), the heat exchanger (30) being disposed in the housing (10); and a
(Continued)

slidable support portion (40) disposed in the housing (10) to support the centrifugal fan (20).

16 Claims, 6 Drawing Sheets

(51) Int. Cl.

| | |
|---|---|
| ***F24F 1/0063*** | (2019.01) |
| ***F04D 29/58*** | (2006.01) |
| ***F04D 29/00*** | (2006.01) |
| ***F24F 1/0011*** | (2019.01) |
| ***F24F 1/0022*** | (2019.01) |
| ***F24F 13/20*** | (2006.01) |
| ***F24F 1/0047*** | (2019.01) |
| ***F24F 1/0067*** | (2019.01) |

(52) U.S. Cl.
CPC ..... *F04D 29/5826* (2013.01); *F24F 1/0011* (2013.01); *F24F 1/0022* (2013.01); *F24F 1/0063* (2019.02); *F24F 13/20* (2013.01); *F24F 1/0047* (2019.02); *F24F 1/0067* (2019.02)

(56) References Cited

U.S. PATENT DOCUMENTS

| | | | | |
|---|---|---|---|---|
| 6,032,479 | A | 3/2000 | Choi et al. | |
| 8,814,639 | B1 * | 8/2014 | Mecozzi | F04D 27/004 454/238 |
| 2004/0244403 | A1 * | 12/2004 | Kim | F04D 17/165 62/419 |
| 2005/0097915 | A1 * | 5/2005 | Joo | F24F 1/0011 62/408 |
| 2006/0254304 | A1 | 11/2006 | Nacenta Anmella | |
| 2007/0113527 | A1 * | 5/2007 | Song | F24F 3/1603 55/471 |
| 2009/0100851 | A1 * | 4/2009 | Yabu | F24F 1/0007 62/259.1 |
| 2013/0092345 | A1 * | 4/2013 | McKie | B23P 15/26 165/7 |
| 2013/0248149 | A1 * | 9/2013 | Kim | F28F 7/00 165/104.19 |
| 2014/0131018 | A1 * | 5/2014 | Lee | F24F 1/0022 165/121 |
| 2014/0374075 | A1 * | 12/2014 | Michitsuji | F24F 1/0014 165/157 |
| 2015/0059400 | A1 * | 3/2015 | Okazaki | F24F 13/30 62/498 |
| 2016/0076790 | A1 * | 3/2016 | Kojima | F24F 1/0014 454/237 |
| 2016/0115967 | A1 * | 4/2016 | Kurihara | F24F 1/0022 416/189 |
| 2016/0138839 | A1 * | 5/2016 | Suhara | F25B 13/00 62/160 |
| 2016/0281998 | A1 * | 9/2016 | Fujita | F24F 1/0022 |
| 2016/0313021 | A1 * | 10/2016 | Nakamura | F24F 1/0022 |
| 2016/0356524 | A1 * | 12/2016 | Yoshitake | F24F 13/32 |

FOREIGN PATENT DOCUMENTS

| | | | |
|---|---|---|---|
| CN | 104061632 | A | 9/2014 |
| CN | 104632720 | A | 5/2015 |
| CN | 204534832 | U | 8/2015 |
| CN | 205402930 | U | 7/2016 |
| CN | 205402930 | U | 9/2016 |
| EP | 0791788 | A2 | 8/1997 |
| EP | 0926452 | A1 | 6/1999 |
| JP | H11190537 | A | 7/1999 |
| JP | 11230566 | A * | 8/1999 |
| JP | H11230566 | A | 8/1999 |
| WO | 2015104791 | A1 | 7/2015 |

OTHER PUBLICATIONS

Extended European search report for EU application No. 17752635.7, dated Sep. 23, 2019.
Application search report for Chinese application No. CN 2016100948997 (filed on Feb. 19, 2016).

* cited by examiner

AIR CONDITIONER

RELATED APPLICATIONS

This application is a 371 of International Patent Application No. PCT/CN2017/072062, filed Jan. 22, 2017, entitled, "Air Conditioner," which claims priority to Chinese Patent Application No. 201610094899.7, filed Feb. 19, 2016, both of which are incorporated herein by reference in their entirety.

TECHNICAL FIELD

The present disclosure relates to the field of refrigeration, and more particularly to an air conditioner.

BACKGROUND

At present, the blade diameter of a centrifugal fan used in an indoor unit of an air conditioner is small. During the rotation of the centrifugal fan, the centrifugal fan shakes slightly, and there is no situation where the centrifugal fan hits other components. However, the centrifugal fan with small-diameter blades will affect the air volume and performance of the air conditioner.

With the improvement of performance requirements of people for air conditioners, the centrifugal fan with the small-diameter blades has been unable to meet the needs of people. Therefore, a large-diameter centrifugal fan is required. As shown in FIG. 1 and FIG. 2, for an indoor fan of a centrifugal fan 20' with large-diameter blades, the centrifugal fan 20' is driven and fixed by a motor in the prior art. As shown in FIG. 2, in order to avoid interference between the centrifugal fan and other components, a distance H provided between a lower surface of the centrifugal fan 20' and an evaporator 30' is greater than or equal to 8 mm. Because the centrifugal fan is large in diameter, the centrifugal fan will have a large amount of shaking. Meanwhile, under the action of gravity, the centrifugal fan will have a tendency of downward deformation, and then the centrifugal fan will hit the other components.

SUMMARY

Some embodiments of the present disclosure is mainly directed to an air conditioner, intended to solve the problem in the prior art that a large-diameter centrifugal fan cannot operate stably.

To this end, an exemplary embodiment provides an air conditioner, including: a housing having an air inlet and an air outlet; a centrifugal fan rotatably disposed in the housing, the centrifugal fan including a plate portion and blades disposed on the plate portion; a heat exchanger, the heat exchanger being disposed in the housing; and a slidable support portion disposed in the housing to support the centrifugal fan.

In an exemplary embodiment, an axis of the centrifugal fan extends along a vertical direction, and the heat exchanger is disposed on a circumferential inner side of the blades.

In an exemplary embodiment, the slidable support portion is disposed between top of the heat exchanger and the plate portion so that the heat exchanger supports the centrifugal fan.

In an exemplary embodiment, the slidable support portion includes a first support portion and a second support portion, the first support portion is disposed on the heat exchanger, and the second support portion is disposed on the plate portion and moves synchronously with the plate portion.

In an exemplary embodiment, the slidable support portion also includes multiple rolling portions disposed on the first support portion, and the second support portion is in contact with the rolling portions.

In an exemplary embodiment, multiple receiving holes are provided on the first support portion, and the multiple rolling portions are mounted in the multiple receiving holes in one-to-one correspondence.

In an exemplary embodiment, the first support portion is of an annular structure, and the multiple receiving holes are arranged along a circumferential direction of the first support portion.

In an exemplary embodiment, the second support portion is provided with at least one annular track fitting the multiple rolling portions.

In an exemplary embodiment, the multiple rolling portions are arranged on the first support portion in multiple turns, and there are multiple annular tracks adapting to the multiple turns.

In an exemplary embodiment, the slidable support portion also includes a connecting piece, and the first support portion is connected to the heat exchanger through the connecting piece.

In an exemplary embodiment, the connecting piece includes a frame and a notch provided on the frame, and the frame is sleeved outside the heat exchanger and is connected to the first support portion through a fastener.

In an exemplary embodiment, the heat exchanger is annular.

In an exemplary embodiment, the slidable support portion includes a first support portion and a second support portion, the first support portion is disposed on the housing, and the second support portion is disposed on the plate portion and moves synchronously with the plate portion.

In an exemplary embodiment, the air inlet is provided at a lower part of the housing.

In an exemplary embodiment, the air outlet is provided on a circumferential side wall of the housing.

By applying the technical solution of some embodiments of the present disclosure, a centrifugal fan is rotatably disposed in a housing of an air conditioner, and the centrifugal fan includes a plate portion and blades disposed on the plate portion. When the air conditioner works, air enters an air inlet of the housing and then exits from an air outlet of the housing due to the effect of the centrifugal fan. In some embodiments of the present disclosure, a heat exchanger is also disposed in the housing of the air conditioner. The heat exchanger can play a role of heat exchange so that the temperature of the air passing through the heat exchanger changes. In addition, a slidable support portion is also disposed in the housing of the air conditioner to support the centrifugal fan. In this way, even if the diameter of the centrifugal fan in some embodiments of the present disclosure is large, due to the supporting action of the slidable support portion, the shaking of the centrifugal fan can be reduced, and the centrifugal fan will not have a tendency of downward deformation due to gravity. Therefore, the technical solution of some embodiments of the present disclosure effectively solves the problem in the prior art that a large-diameter centrifugal fan cannot operate stably.

BRIEF DESCRIPTION OF THE DRAWINGS

The drawings of the description, forming a part of the present application, are used to provide a further understanding for the present disclosure. The schematic embodiments and illustrations of the present disclosure are used to explain the present disclosure, and do not form improper limits to the present disclosure. In the drawings.

The drawings include the following reference signs:

20', centrifugal fan; 30', evaporator; 10, housing; 11, air inlet; 12, air outlet; 20, centrifugal fan; 21, plate portion; 22, blade; 30, heat exchanger; 40, slidable support portion; 41, first support portion; 42, second support portion; 43, rolling portion; 44, connecting piece.

DETAILED DESCRIPTION OF THE EMBODIMENTS

It is important to note that embodiments in the present application and characteristics in the embodiments may be combined under the condition of no conflicts. The present disclosure will be illustrated hereinbelow with reference to the drawings and in conjunction with the embodiments in detail.

Figure 1:
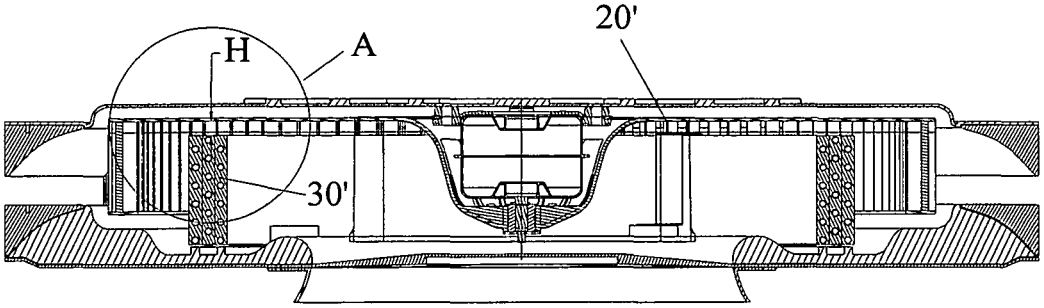
FIG. 1 shows a structural schematic view of an air conditioner in the prior art.
Figure 2:
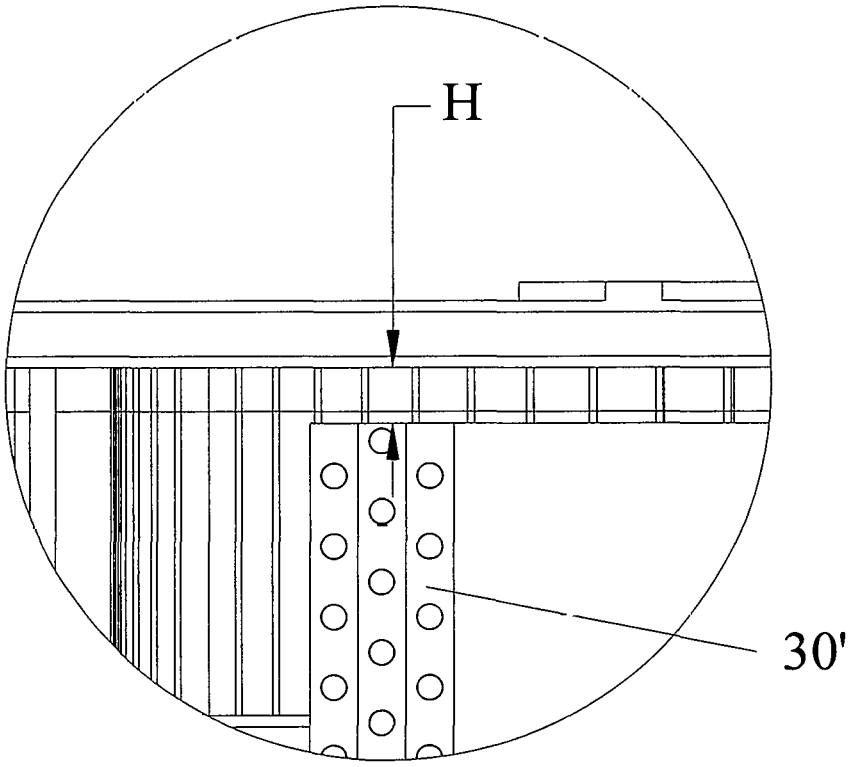
FIG. 2 shows an enlarged schematic view of A of the air conditioner in FIG. 1.
Figure 3:
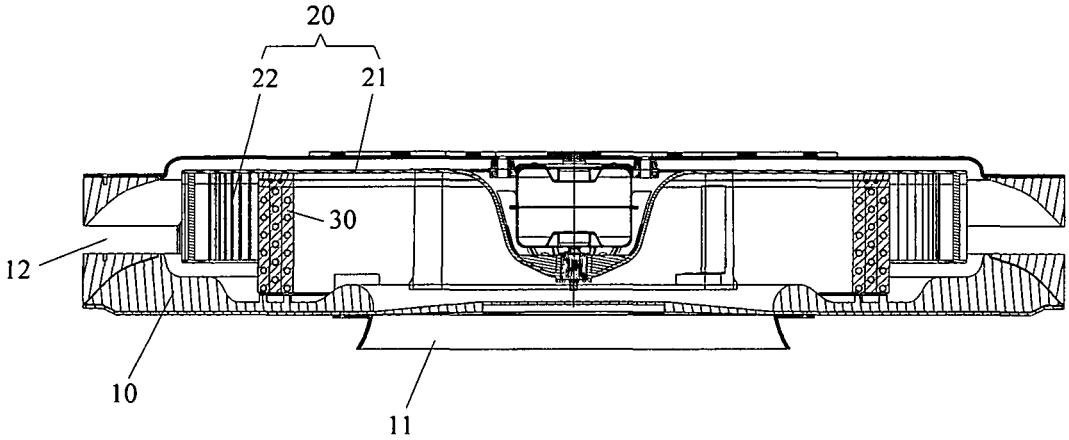
FIG. 3 shows a schematic view of a longitudinal section structure of an embodiment for an air conditioner according to the present disclosure.
Figure 4:
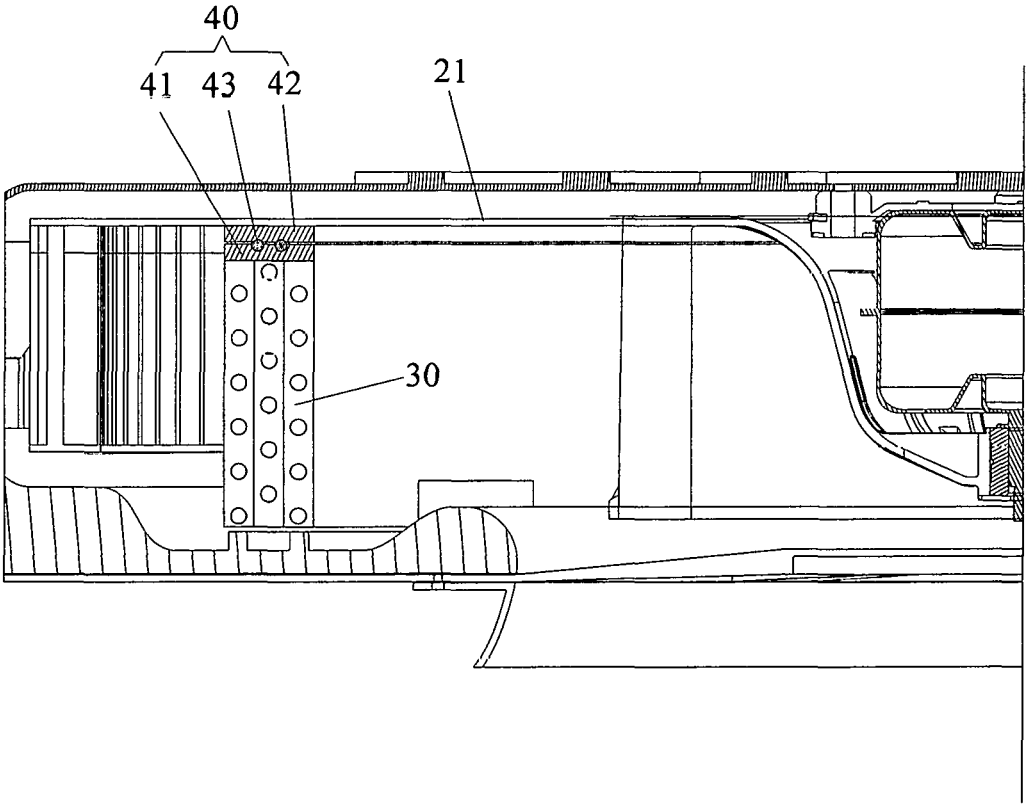
FIG. 4 shows a partial enlarged schematic view of the air conditioner in FIG. 3.

As shown in FIG. 3 and FIG. 4, an air conditioner in the present embodiment includes a housing 10, a centrifugal fan 20, a heat exchanger 30, and a slidable support portion 40, wherein the housing 10 has an air inlet 11 and an air outlet 12; the centrifugal fan 20 is rotatably disposed in the housing 10, and the centrifugal fan 20 includes a plate portion 21 and blades 22 disposed on the plate portion 21; the heat exchanger 30 is disposed on a circumferential inner side of the blades 22; and the slidable support portion 40 is disposed between top of the heat exchanger 30 and the plate portion 21 so that the heat exchanger 30 supports the centrifugal fan 20.

By applying the technical solution of the present embodiment, the centrifugal fan 20 is rotatably disposed in the housing 10 of an air conditioner, and the centrifugal fan 20 includes the plate portion 21 and the blades 22 disposed on the plate portion 21. When the air conditioner works, air enters the air inlet 11 of the housing 10 and then exits from the air outlet 12 of the housing 10 due to the effect of the centrifugal fan. In the present embodiment, the heat exchanger 30 is also disposed in the housing 10 of the air conditioner. The heat exchanger 30 can play a role of heat exchange so that the temperature of the air passing through the heat exchanger 30 changes. In addition, the slidable support portion 40 is also disposed in the housing 10 of the air conditioner to support the centrifugal fan 20. In this way, even if the diameter of the centrifugal fan 20 in the present application is large, due to the supporting action of the slidable support portion 40, the shaking of the centrifugal fan 20 can be reduced, and the centrifugal fan 20 will not have a tendency of downward deformation due to gravity. Therefore, the technical solution of the present embodiment effectively solves the problem in the prior art that a large-diameter centrifugal fan cannot operate stably.

Figure 5:
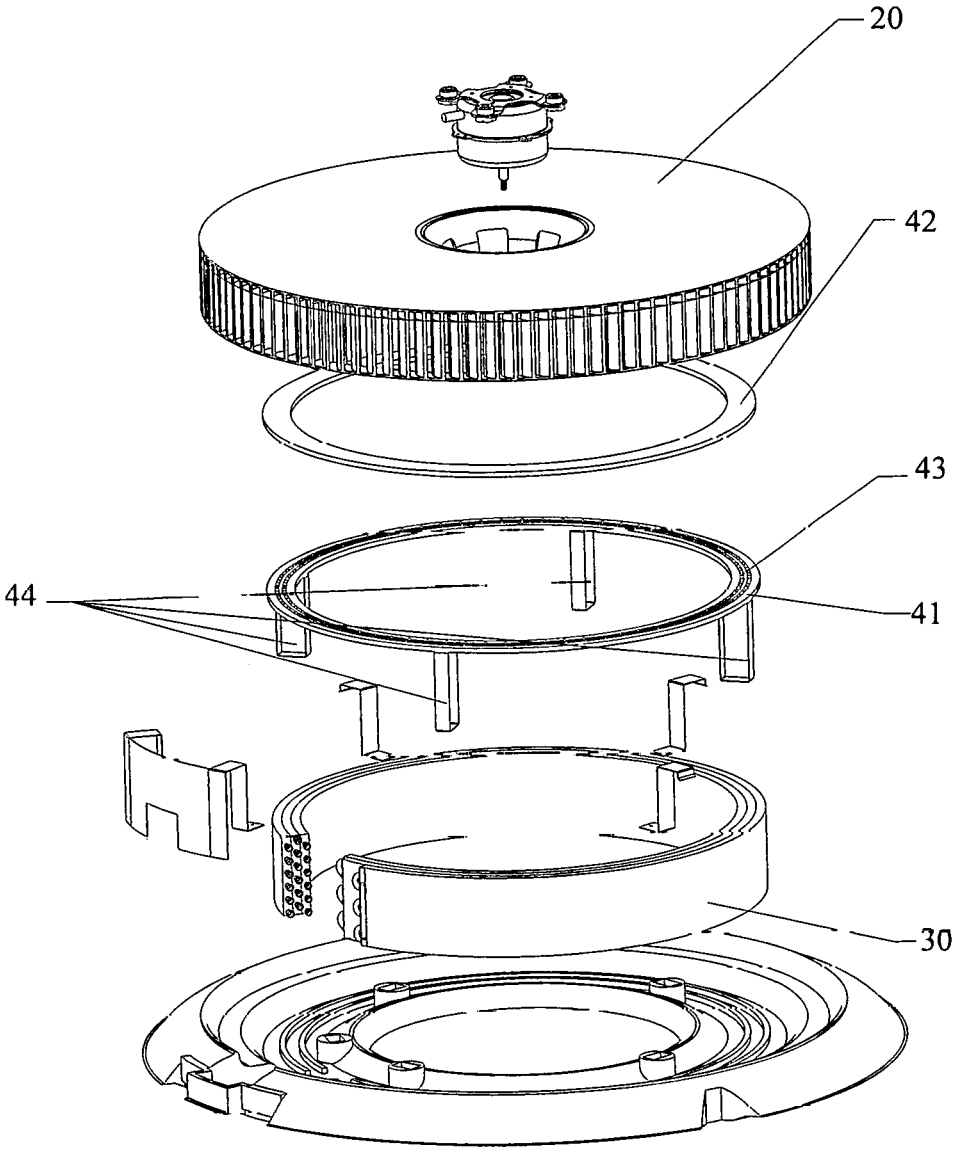
FIG. 5 shows an exploded schematic view of a partial structure of the air conditioner in FIG. 3.

As shown in FIG. 5, the heat exchanger 30 and the housing 10 are connected through multiple metal sheets. The structure is simple, and easy to implement. In the present embodiment, the centrifugal fan 20 is driven by a motor, and the power of the motor is input from the center of the plate portion 21.

As shown in FIG. 3, in the present embodiment, an axis of the centrifugal fan 20 extends along a vertical direction, and the heat exchanger 30 is disposed on a circumferential inner side of the blades 22. The structure is simple and enables air entering the air conditioner to be more uniform in heat exchange.

As shown in FIG. 3 and FIG. 4, in the present embodiment, the slidable support portion 40 is disposed between top of the heat exchanger 30 and the plate portion 21 so that the heat exchanger 30 supports the centrifugal fan 20. The structure is simple, and easy to implement. The structure uses the heat exchanger 30 as a part of a support structure, which makes the structure of the air conditioner more compact, reduces the volume of a product, and enhances the appearance of the product.

As shown in FIG. 4, in the present embodiment, the slidable support portion 40 includes a first support portion 41 and a second support portion 42, the first support portion 41 is disposed on the heat exchanger 30, and the second support portion 42 is disposed on the plate portion 21 and moves synchronously with the plate portion 21. The structure enables the relative movement between the first support portion 41 and the second support portion 42 so as to ensure the normal operation of the air conditioner. Meanwhile, due to the action of gravity, the centrifugal fan 20 has a tendency of downward deformation when the air conditioner works, so the second support portion 42 on the plate portion 21 will also have a tendency of downward deformation. By applying the technical solution of the present embodiment, the heat exchanger 30 has a first support portion 41 that can fit the second support portion 42 so as to play a supporting role for the second support portion 42, that is, a supporting role for the centrifugal fan 20, thereby further enabling the large-diameter centrifugal fan 20 to operate stably and reliably.

As shown in FIG. 4, in the present embodiment, multiple rolling portions 43 are mounted on the first support portion 41, and the second support portion 42 is in contact with the rolling portions 43. Firstly, the structure is simple, and rolling friction is generated between the first support portion 41 and the second support portion 42 by providing the rolling portions 43. Since the rolling friction force is small, the relative rotation between the first support portion 41 and the second support portion 42 is made easier, so that the abrasion between the first support portion 41 and the second support portion 42 is reduced, thereby ensuring the life of the air conditioner. Secondly, under the action of gravity, the plate portion 21 and the second support portion 42 on the plate portion 21 press the multiple rolling portions 43 and the first support portion 41, thereby supporting the centrifugal fan 20. Preferably, the rolling portions 43 are balls, and the structure is simple, and easy to implement. Of course, those skilled in the art should know that the rolling portions 43 may have other structures besides the balls. Specifically, the rolling portions may also be pulleys.

Figure 8:
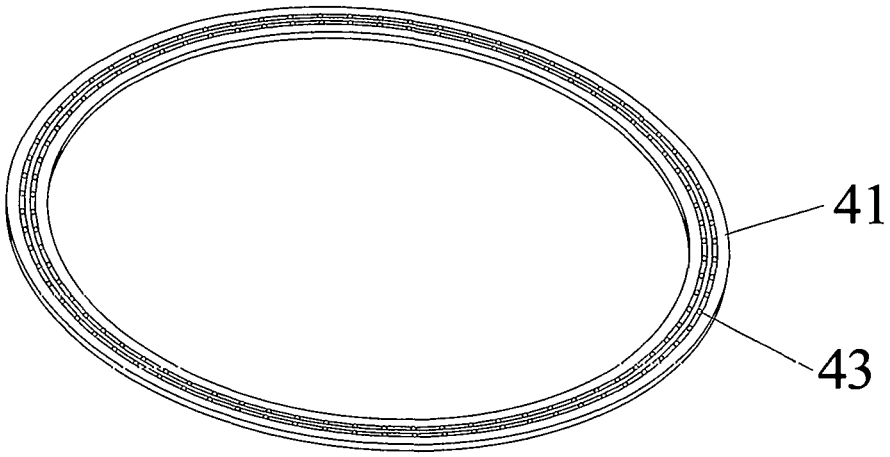
FIG. 8 shows a schematic view of a fitting state between a first support portion and a ball of the air conditioner in FIG. 3.
Figure 9:
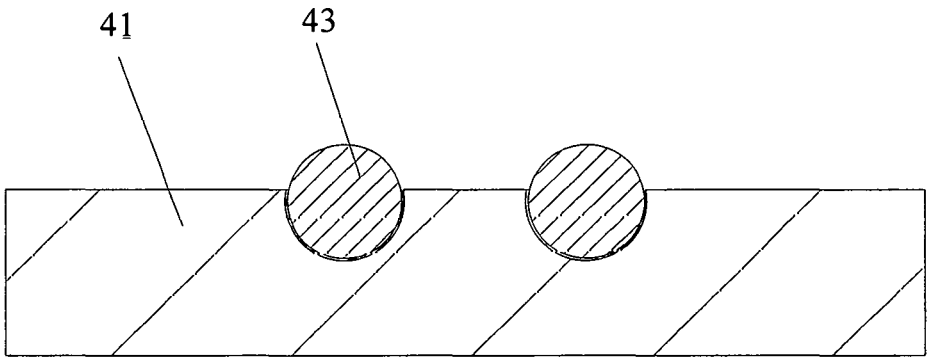
FIG. 9 shows a sectional schematic view of a fitting state between the first support portion and the ball in FIG. 8.

The following describes the present embodiment with the rolling portions 43 as the balls. As shown in FIG. 8 and FIG. 9, in the present embodiment, multiple receiving holes are provided on the first support portion 41, and multiple the balls are mounted in the multiple receiving holes in one-to-one correspondence. The structure allows the balls to always be at a working position and enables the balls to normally roll.

As shown in FIG. 5 and FIG. 8, in the present embodiment, the first support portion 41 is of an annular structure, and the multiple receiving holes are arranged along a circumferential direction of the first support portion 41. The structure is simple, and easy to implement.

Figure 10:
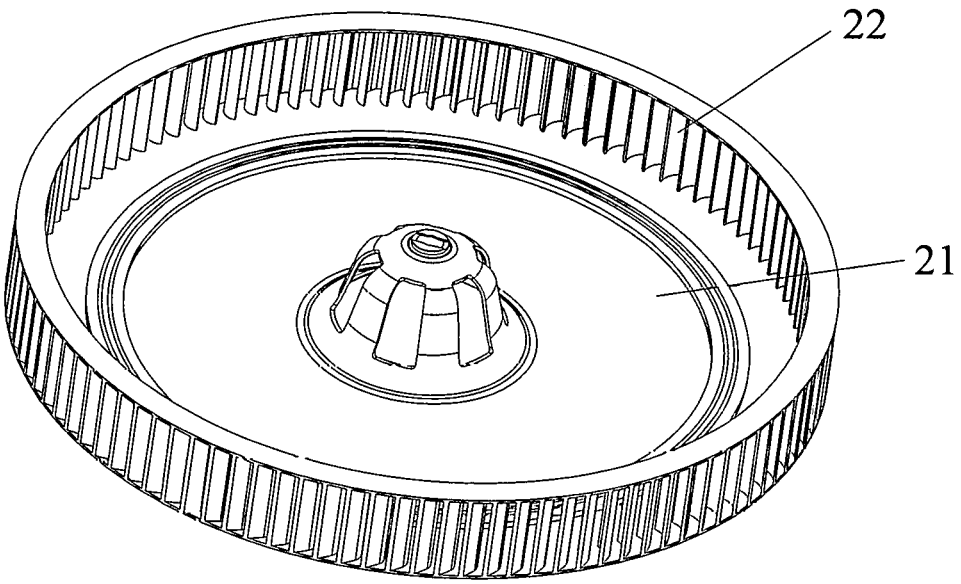
FIG. 10 shows a structural schematic view of a centrifugal fan of the air conditioner in FIG. 3.

As shown in FIG. 5 and FIG. 10, in the present embodiment, the second support portion 42 is provided with at least one annular track fitting the balls. The structure allows the balls to always be at a working position and ensures relative rotation between the first support portion 41 and the second support portion 42. Moreover, because the balls fit the annular track on the second support portion 42, the structure of the entire air conditioner is more compact.

As shown in FIG. 8 to FIG. 10, in the present embodiment, the multiple balls are arranged on the first support portion 41 in multiple turns, and there are multiple annular tracks adapting to the multiple turns. The structure enables a better relative rotation between the first support portion 41 and the second support portion 42 while better supporting the centrifugal fan 20.

Figure 6:
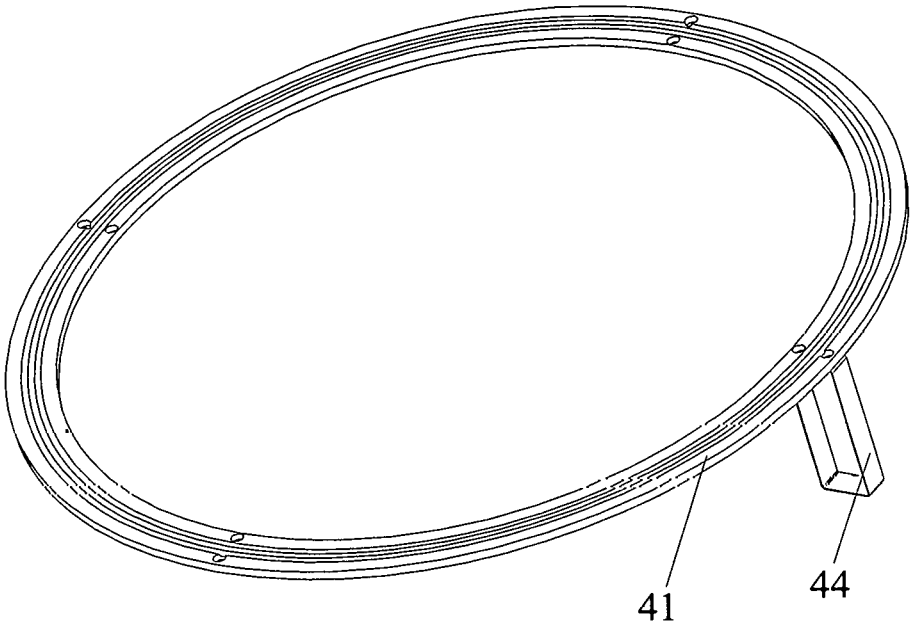
FIG. 6 shows a schematic view of a fitting state between a first support part and a connecting piece of the air conditioner in FIG. 3.
Figure 7:
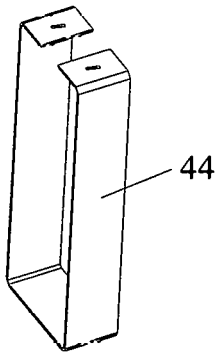
FIG. 7 shows a structural schematic view of the connecting piece in FIG. 6.

As shown in FIG. 6 and FIG. 7, in the present embodiment, the air conditioner also includes a connecting piece 44, and the first support portion 41 is connected to the heat exchanger 30 through the connecting piece 44. The structure is simple, and easy to implement.

As shown in FIG. 6 and FIG. 7, in the present embodiment, the connecting piece 44 includes a frame sleeved outside the heat exchanger 30 and a notch provided on the frame. The notch enables the frame to be easily sleeved on the heat exchanger 30. When the frame is sleeved on the heat exchanger 30, the connecting piece 44 may be connected to the first support portion 41 through a fastener, so that the first support portion 41 is fixed to the heat exchanger 30. Preferably, the fastener may be a screw, and a screw hole adapting to the screw is provided around the notch of the frame and on the first support portion 41. Of course, those skilled in the art should know that the shape of the frame is not limited, and in the present embodiment, the frame is a rectangular frame.

As shown in FIG. 3 and FIG. 4, in the present embodiment, the heat exchanger 30 is annular. The structure can fully utilize the heat exchanger 30 for heat exchange. Of course, the heat exchanger 30 may be provided in multiple layers in a radial direction thereof depending on the need of refrigeration or heating. Air that needs heat exchange passes through the multi-layer heat exchanger, making the heat exchange of the air fuller.

In an embodiment not shown in the figures, the slidable support portion 40 includes a first support portion 41 and a second support portion 42, the first support portion 41 is disposed on the housing 10, and the second support portion 42 is disposed on the plate portion 21 and moves synchronously with the plate portion 21. The structure is simple, and easy to implement.

As shown in FIG. 3, in the present embodiment, the air inlet 11 is provided at a lower part of the housing 10. Air enters the air conditioner from the air inlet 11 at the lower part of the housing 10, and is discharged from the air conditioner through the heat exchanger 30. Specifically, the center position of the air inlet 11 is located on a rotation axis of the centrifugal fan 20. In this way, the air enters from the center of the centrifugal fan 20, and the structure ensures that the inlet air volume, the outlet air volume and the outlet air temperature are more uniform.

As shown in FIG. 3, in the present embodiment, the air outlet 12 is provided on a circumferential side wall of the housing 10. The structure makes full use of the space of the air conditioner, so that the structure of the air conditioner is compact. Specifically, the air outlet 12 is annular. In this way, the air conditioner may achieve a 360-degree air output, and the air conditioner ensures that the temperature in the indoor area is uniformly increased or decreased.

The above is only the preferable embodiments of the present disclosure, and not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. An air conditioner, wherein the air conditioner comprises:

a housing (10), having an air inlet (11) and an air outlet (12);

a centrifugal fan (20) rotatably disposed in the housing (10), the centrifugal fan (20) comprising a plate portion (21) and blades (22) disposed on the plate portion (21);

a heat exchanger (30), the heat exchanger (30) being disposed in the housing (10); and a slidable support portion (40) disposed in the housing (10) to support the centrifugal fan (20), wherein an axis of the centrifugal fan (20) extends along a vertical direction, and the heat exchanger (30) is disposed on a circumferential inner side of the blades (22), the slidable support portion (40) is disposed top of the heat exchanger (30) and the plate portion (21) so that the heat exchanger (30) supports the centrifugal fan (20).

2. The air conditioner as claimed in claim 1, wherein the slidable support portion (40) comprises a first support portion (41) and a second support portion (42), the first support portion (41) is disposed on the heat exchanger (30), and the second support portion (42) is disposed on the plate portion (21) and moves synchronously with the plate portion (21).

3. The air conditioner as claimed in claim 2, wherein the slidable support portion (40) further comprises multiple rolling portions (43) disposed on the first support portion (41), and the second support portion (42) is in contact with the rolling portions (43).

4. The air conditioner as claimed in claim 3, wherein multiple receiving holes are provided on the first support portion (41), and the multiple rolling portions (43) is mounted in the multiple receiving holes in one-to-one correspondence.

5. The air conditioner as claimed in claim 4, wherein the first support portion (41) is of an annular structure, and the multiple receiving holes are arranged along a circumferential direction of the first support portion (41).

6. The air conditioner as claimed in claim 3, wherein the second support portion (42) is provided with at least one annular track fitting the multiple rolling portions (43).

7. The air conditioner as claimed in claim 6, wherein the multiple rolling portions (43) are arranged on the first support portion (41) in multiple turns, and there are multiple annular tracks adapting to the multiple turns.

8. The air conditioner as claimed in claim 2, wherein the slidable support portion (40) further comprises a connecting piece (44), and the first support portion (41) is connected to the heat exchanger (30) through the connecting piece (44).

9. The air conditioner as claimed in claim 8, wherein the connecting piece (44) comprises a frame and a notch provided on the frame, and the frame is sleeved outside the heat exchanger (30) and is connected to the first support portion (41) through a fastener.

10. The air conditioner as claimed in claim 1, wherein the heat exchanger (30) is annular.

11. The air conditioner as claimed in claim 1, wherein the slidable support portion (40) comprises a first support portion (41) and a second support portion (42), the first support portion (41) is disposed on the housing (10), and the second support portion (42) is disposed on the plate portion (21) and moves synchronously with the plate portion (21).

12. The air conditioner as claimed in claim 1, wherein the air inlet (11) is provided at a lower part of the housing (10).

13. The air conditioner as claimed in claim 1, wherein the air outlet (12) is provided on a circumferential side wall of the housing (10).

14. The air conditioner as claimed in claim 1, in wherein the air inlet (11) is provided at a lower part of the housing (10).

15. The air conditioner as claimed in claim 1, wherein the air outlet (12) is provided on a circumferential side wall of the housing (10).

16. The air conditioner as claimed in claim 2, wherein the air inlet (11) is provided at a lower part of the housing (10).

* * * * *